United States Patent [19]

Kraus

[11] Patent Number: 4,534,730

[45] Date of Patent: Aug. 13, 1985

[54] METHOD OF AND APPARATUS FOR FORMING A LINER IN A FURNACE OR OTHER VESSEL

[75] Inventor: Richard B. Kraus, Barrington, Ill.

[73] Assignee: General Kinematics Corporation, Barrington, Ill.

[21] Appl. No.: 615,773

[22] Filed: May 31, 1984

[51] Int. Cl.[3] ..... F27D 1/16; C21B 7/04

[52] U.S. Cl. ..... 432/3; 266/281; 373/162

[58] Field of Search ..... 432/3; 264/30; 266/281; 373/162

[56] References Cited

U.S. PATENT DOCUMENTS

| | | | |
|---|---|---|---|
| 375,965 | 1/1888 | Versen | 425/110 |
| 3,492,383 | 1/1970 | Heimgartner | 264/30 |
| 3,637,171 | 1/1972 | Kroeger | 264/30 |
| 4,039,175 | 8/1977 | Beckers | 264/30 |
| 4,140,459 | 2/1979 | Egli et al. | 425/431 |
| 4,155,541 | 5/1979 | Zorzi | 266/281 |
| 4,272,020 | 6/1981 | Allison | 266/281 |

FOREIGN PATENT DOCUMENTS

| | | | |
|---|---|---|---|
| 679630 | 8/1979 | U.S.S.R. | 266/281 |

*Primary Examiner*—John J. Camby

*Attorney, Agent, or Firm*—Wood, Dalton, Phillips, Mason & Rowe

[57] ABSTRACT

A method of and an apparatus for forming a liner in an induction furnace is disclosed. The apparatus includes a hopper for storing particulate refractory material and a plurality of material delivery tubes communicating with the hopper and extending into the space between a form disposed in the furnace and a furnace wall. A compaction plate is also disposed in the space and includes a plurality of bores therethrough which communicate with the material delivery tubes. Vibrating means vibrate the hopper, material delivery tubes and the compaction plate so that the particulate refractory material is transferred from the hopper to the space between the form and the furnace wall through the material delivery tubes and the compaction plate bores and is compacted by the compaction plate to form the liner.

10 Claims, 4 Drawing Figures

12
38
13
16
30
20
32
20
18
18
14
22
22
50
54
56
24
24
52

METHOD OF AND APPARATUS FOR FORMING A LINER IN A FURNACE OR OTHER VESSEL

BACKGROUND OF THE INVENTION

1. Technical Field

The present invention relates generally to furnaces of the induction or arc type, and more particularly to a method of and apparatus for lining such a furnace with refractory material.

2. Background Art

Induction or arc furnaces, before use, are typically lined with refractory material to protect the walls of the furnace. The lining is constructed by first placing a shell or form in the furnace, the shell cross-sectional area being smaller than that of the furnace so that a space or void separates the walls of the furnace from the shell. A particulate refractory material is then deposited in the space or void and a vibrator is placed within the shell to vibrate same to thereby compact the refractory material into a solid mass. A vibrator which accomplishes this function is disclosed in Kroeger U.S. Pat. No. 3,637,171 and in Beckers U.S. Pat. No. 4,039,175.

While prior methods and apparatus have been found to be useful in lining an induction furnace, they can result in the release of a large amount of particulate matter into the atmosphere near the furnace, thereby creating a health hazard for those in the vicinity. Furthermore, prior methods and apparatus tend to cause segregation of the particulate material, thereby resulting in a non-homogeneous liner having less than optimal qualities. It would be desirable to reduce the amount of released particulate matter in the atmosphere during a lining operation and also reduce the incidence of particulate segregation.

SUMMARY OF THE INVENTION

In accordance with the present invention, a method of and apparatus for lining a furnace with particulate refractory material substantially lessens the quantity of particulate material released into the atmosphere, and also reduces particulate segregation.

The apparatus of the present invention includes a hopper or reservoir which stores a quantity of particulate refractory material, a plurality of material delivery tubes communicating with the hopper or reservoir and extending into the space between the shell or form and the walls of the furnace and a compaction plate or ring disposed in the space having a plurality of bores therethrough which communicate with the material delivery tubes. Means are included for vibrating the hopper, material delivery tubes and the compaction plate.

The method of the present invention includes the step of vibrating the hopper, material delivery tubes and the compaction plate or ring so that the particulate refractory material is transferred from the hopper to the space between the shell and the furnace walls through the material delivery tubes and the compaction plate bores. This vibration also causes the compaction plate to compact the particulate refractory material into a solid mass between the shell and the furnace walls.

Since the particulate matter is delivered through enclosed tubes to the space between the form and the furnace walls, the chance of escape of the particulate material into the atmosphere is minimized. Furthermore, the vibration of the compaction plate ensures that the refractory material is formed into a solid mass without voids before the material can segregate a substantial amount so that the material can be subsequently sintered into a well-constructed liner.

DESCRIPTION OF THE PREFERRED EMBODIMENT

Figure 1:
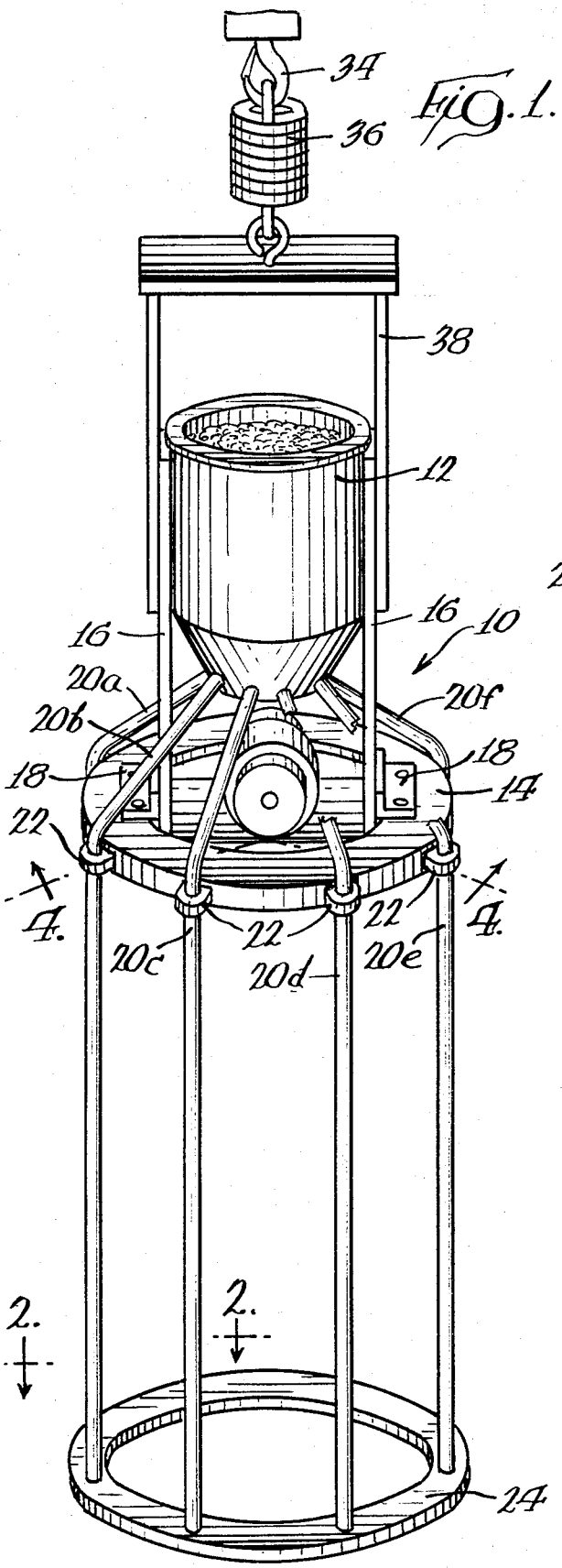
FIG. 1 is a perspective view of the liner forming apparatus according to the present invention.

Referring now to FIG. 1, there is illustrated a preferred form of the liner forming apparatus 10 of the present invention. The apparatus 10 includes a receptacle in the form of a hopper or reservoir 12 which is mounted on a base 14 by means of a first support 16 and brackets 18. The hopper 12 is connected to and communicates with a plurality of material delivery tubes 20, of which six tubes numbered 20*a*–20*f* are shown in FIG. 1. In a preferred embodiment, there are eight such material delivery tubes which are held in place on the base 14 by collars 22.

It should be noted that the material delivery tubes are preferably equally spaced about the periphery of the base 14 and are joined to the hopper 12 at equally spaced intervals as well. This assures that an even delivery of particulate matter is accomplished. The number of material delivery tubes can be varied, as desired.

The material delivery tubes are fabricated of a rigid material and extend downwardly away from the base 14. Joined to the bottom of the material delivery tubes 20 is a compaction plate or ring 24 which, as illustrated in FIG. 1, has a circular ring shape in cross-section. It should be noted that the plate or ring 24 can be any other shape, as desired, providing that it is configured to fit between the walls of a furnace to be lined and a shell or form disposed therein, as noted more specifically below.

Figure 2:
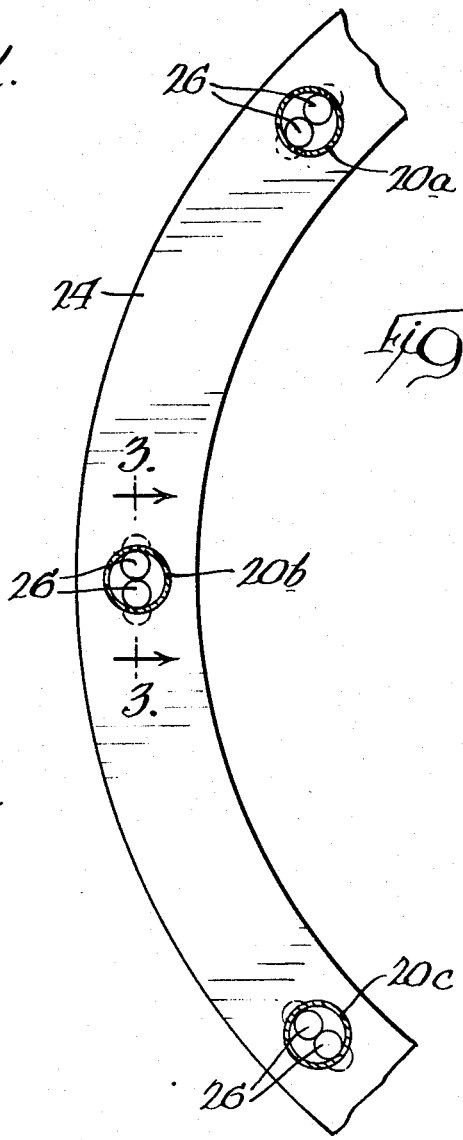
FIG. 2 is a fragmentary sectional view taken along the line 2—2 of FIG. 1.
Figure 3:
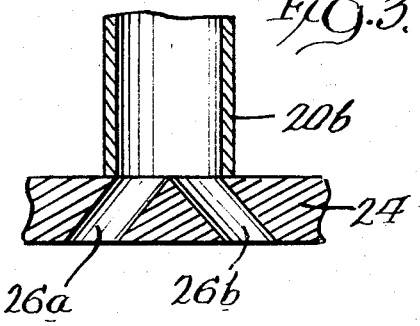
FIG. 3 is a fragmentary sectional view taken along the line 3—3 of FIG. 2.

With reference to FIG. 2, in the preferred embodiment the ring or compaction plate 24 includes a plurality of bores 26 which communicate with the interior of the material delivery tubes 20. With reference also to FIG. 3, in the preferred embodiment a pair of bores 26*a*,26*b* communicate with the interior of each delivery tube 20. It should be noted that any number of bores can communicate with each delivery tube 20, the primary considerations in the selection of the number of bores being the required strength of the plate or ring 24, the rate at which particulate matter is to be delivered through the bores and the size of the particulate matter. The plate 24 could be reinforced and weighted as desired.

It should be noted that stiffening rings (not shown) may be provided at one or more points along the length of the tubes 22 and joined thereto to provide greater rigidity for the tubes, if desired.

Figure 4:
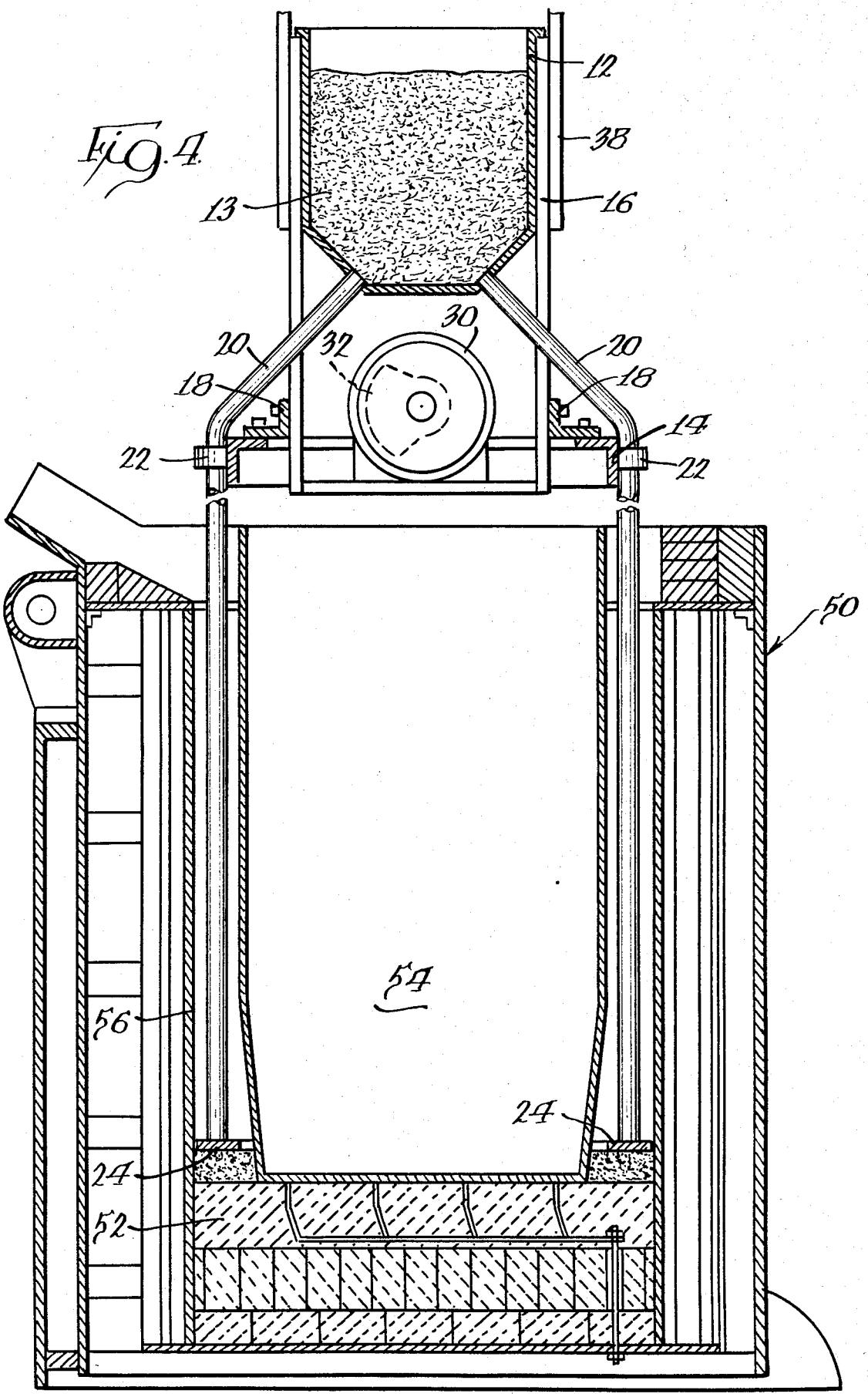
FIG. 4 is a sectional view taken along the line 4—4 of FIG. 1 shown in conjunction with a generally similar sectional view of an induction furnace.

Referring again to FIG. 1, a vibration generating member 28 is provided and in one form includes a motor 30 mounted on the base 14 and having one or more eccentric weights 32 (one of which is shown in phantom in FIG. 4). The vibration generating member 28 may be of the variable force type such as shown in U.S. Pat.

No. 4,168,744 to Musschoot and wherein the vibratory force generated by the member may be varied depending on the flow characteristics of the material, the atmospheric conditions, the length of flow path and the like. The vibration generating member, when energized, vibrates the hopper 12, material delivery tubes 22 and the compaction plate or ring 26, as noted more specifically below.

The liner forming apparatus 10 is suspended by a hoist or other carrying apparatus (only a hook 34 of which is shown in the figures) by means of an isolation spring 36 which joins the hooke 34 to a second support 38 which in turn is secured to the first support 16.

Referring now specifically to FIG. 4, the method of the present invention is described in connection with the building of a lining in an induction furnace 50. It should be noted that the method and apparatus of the present invention can be utilized to build liners in other types of vessels or crucibles, as appropriate.

The first step in the method is to build a base 52 of refractory material on the bottom of the furnace 50. The base 52 may be constructed from refractory brick or by compaction of particulate refractory material, as desired. A form or shell 54 is then placed atop the base 52, the form 54 having a cross-sectional diameter less than the diameter of an inner wall 56 of the furnace 50. A space or void thereby separates the outer periphery of the form 54 and the furnace wall 56. The form 54 is centered inside the wall 56 so that the space therebetween is equal about the form 54.

The next step in the method is to suspend the apparatus 10 so that the compaction plate or ring 24 and the material delivery tubes 20 extend into the space between the form 54 and the inner wall 56 and the compaction plate 24 is disposed atop the base 52. This is accomplished by means of the hoist or other lifting device previously described. Once this has been accomplished, the motor 30 of the vibration generating member is energized to vibrate the hopper 12, material delivery tubes 20 and the compaction plate or ring 24. This vibration in turn causes the particulate matter 13 within the hopper 12 to travel through the material delivery tubes 20 and the bores 26 in the compaction plate or ring 24 so that the material is transferred into the space between the form 54 and the furnace wall 56. The vibration induced by the motor 30 also causes the compaction plate or ring 24 to tamp or compact the transferred refractory material into the void or space between the form 54 and the inner wall 56 so that a solid mass of refractory material is built up therein.

The vibration caused by the vibratory apparatus is not transmitted to the hoist or other lifting device due to the isolation provided by the isolation spring 36.

The vibrations of the member 28 and the discharge of the material from the tubes 20 through the bores 26 may cause the line forming apparatus 10 to oscillate, to walk or to turn about its vertical axis so that an even layer of material is laid down and tamped. A positive walking or oscillating motion can be created by an appropriate adjustment and/or orientation of the eccentric weights in the vibratory member 28.

The vibration caused by energization of the motor continues until the entire space between the form 54 and the inner wall 56 is filled to the top of the furnace 50. At this point, the motor 30 is de-energized and the liner forming apparatus 10 is moved away from the furnace so that additional processing of the refractory material can be accomplished.

Since the refractory material is delivered by means of tubes directly to the space which is to be lined, the chance of escape of particulate matter into the atmosphere is minimized and hence the work environment is rendered safer, thereby obviating the need for safety equipment. Also, the material is compacted immediately upon delivery to the space, thereby preventing substantial segregation of the particulate material and insuring that the material is formed into a solid, homogeneous mass having good linear qualities.

I claim:

1. An apparatus for forming a lining of particulate material in a vessel having an inner wall, a form being disposed in the vessel and being of a size such that a space separates the form from the inner wall, comprising:

a hopper for storing the particulate material;

a plurality of material delivery tubes communicating with the hopper and extending into the space between the form and the inner wall;

a compaction plate disposed in the space and having a plurality of bores therethrough communicating with the material delivery tubes; and means for vibrating the hopper, material delivery tubes and the compaction plate so that the particulate material is transferred from the hopper to the space through the material delivery tubes and the compaction plate bores and is compacted by the compaction plate.

2. The apparatus of claim 1, wherein the compaction plate is ring-shaped.

3. The apparatus of claim 1, wherein each material delivery tube communicates with a pair of bores in the compaction plate.

4. The apparatus of claim 1, further including a base upon which the hopper is mounted, the material delivery tubes being secured to the base and to the hopper such that the tubes are equally spaced about the hopper and base.

5. The apparatus of claim 1, wherein the vibrating means comprises a motor having an eccentric weight.

6. An apparatus for forming a lining of particulate refractory material in a furnace having an inner wall, a form being disposed in the furnace and being of a size such that a space separates the form from the inner wall, comprising:

a base;

a hopper disposed on the base for storing the particulate refractory material;

a plurality of material delivery tubes secured to and communicating with the hopper at equally spaced points thereabout, the material delivery tubes also being secured to the base at equally spaced points thereabout and extending into the space between the form and the inner wall;

a ring-shaped compaction plate disposed in the space having a plurality of bores therethrough, the compaction plate being secured to the material delivery tubes such that each tube communicates with at least two bores; and means for vibrating the hopper, the material delivery tubes and the compaction plate so that the particulate refractory material is transferred from the hopper to the space through the tubes and the bores and is compacted in the space by the compaction plate.

7. A method of forming a liner of particulate material in a vessel utilizing liner forming apparatus having a hopper for storing the particulate material, a plurality of material delivery tubes communicating with the hopper and a compaction plate disposed on the ends of the material delivery tubes having bores therethrough which communicate with the tubes, comprising the steps of:

building a base of material on the bottom of the vessel;

placing a form in the vessel atop the base of material such that a space separates the walls of the vessel from the form;

suspending the liner forming apparatus so that the compaction plate and at least a portion of the material delivery tubes extend into the space between the form and the vessel walls; and vibrating the liner forming apparatus so that the particulate material is transferred from the hopper to the space through the tubes and the bores in the compaction plate and so that the material is compacted by the compaction plate.

8. The method of claim 7, wherein the step of vibrating includes the step of energizing a motor disposed on the liner forming apparatus having an eccentric weight.

9. The method of claim 7, wherein the step of suspending includes the step of joining the liner forming apparatus to a hoist by means of an isolation spring.

10. A method of forming a liner of particulate refractory material in a furnace utilizing liner forming apparatus having a hopper for storing the particulate refractory material, a plurality of material delivery tubes secured to and communicating with the hopper at points equally spaced about the hopper and a compaction plate disposed on the ends of the material delivery tubes remote from the hopper having bores therethrough which communicate with the tubes, comprising the steps of:

building a base of refractory material on the bottom of the furnace;

placing a form in the furnace atop the base of refractory material so that a space separates the walls of the furnace from the form;

suspending the liner forming apparatus by means of a hoist and an isolation spring so that the compaction plate extends into the space between the form and the vessel walls and contacts the base of refractory material; and vibrating the liner forming apparatus so that the particulate refractory material is transferred from the hopper to the space through the tubes and the bores in the compaction plate and so that the particulate refractory material is compacted by the compaction plate atop the base of refractory material.

* * * * *